US005582289A

United States Patent [19]

Wright

[11] Patent Number: 5,582,289

[45] Date of Patent: Dec. 10, 1996

[54] COMPOSITE ARTICLE CARRIER

[75] Inventor: James W. Wright, Woodstock, Ga.

[73] Assignee: The Mead Corporation, Dayton, Ohio

[21] Appl. No.: 385,938

[22] Filed: Feb. 9, 1995

[51] Int. Cl.[6] ..... B65D 75/00

[52] U.S. Cl. ..... 206/139; 206/147; 206/159; 206/162; 206/165; 206/429

[58] Field of Search ..... 206/139, 142, 206/147, 148, 156, 159, 162, 163, 165, 171, 193, 194, 197, 200, 427, 429, 144, 166; 294/87.2, 87.26

[56] References Cited

U.S. PATENT DOCUMENTS

| | | | |
|---|---|---|---|
| 1,973,035 | 9/1934 | Borron | 206/193 X |
| 2,134,627 | 10/1938 | Turner | 206/193 |
| 2,252,235 | 8/1941 | Snelling | 294/87.2 |
| 2,299,625 | 10/1942 | Holmes | 294/87.2 X |
| 2,320,440 | 6/1943 | Kruea et al. | 206/142 X |
| 2,331,312 | 10/1943 | Dorfman | 206/194 X |
| 2,437,667 | 3/1948 | Smith | 294/87.26 |
| 2,529,675 | 11/1950 | Brulin | 206/193 X |
| 2,732,983 | 1/1956 | Siddall | 206/194 |
| 2,748,978 | 6/1956 | Hennessey et al. | 206/166 |
| 2,804,234 | 8/1957 | Lachance | 206/196 |
| 3,085,682 | 4/1963 | Poupitch | 206/159 |
| 3,167,347 | 1/1965 | Hewlings | 294/87.2 |
| 3,198,379 | 8/1965 | Creelman | 206/165 |
| 3,257,027 | 6/1966 | Weiss | 206/200 |
| 3,387,702 | 6/1968 | Reynolds et al. | 206/162 |
| 3,394,845 | 7/1968 | Vilanova | 206/193 |
| 3,712,533 | 1/1973 | Skillen | 206/139 X |
| 3,773,214 | 11/1973 | Lemon | 206/199 |
| 3,897,873 | 8/1975 | Graser | 206/153 |
| 4,049,116 | 9/1977 | Cope | 206/176 |
| 4,872,766 | 10/1989 | Dancy | 383/10 |
| 5,065,937 | 11/1991 | Ritter | 206/193 X |
| 5,167,325 | 12/1992 | Sykora | 206/193 |
| 5,328,024 | 7/1994 | Sutherland | 206/158 |

FOREIGN PATENT DOCUMENTS

| | | | |
|---|---|---|---|
| 1181153 | 6/1959 | France . | |
| 2169442 | 8/1973 | France . | |
| 3030307A1 | 3/1982 | Germany . | |
| 60-24763 | 2/1985 | Japan . | |
| 933977 | 8/1963 | United Kingdom | 206/165 |
| WO93/25439 | 12/1993 | WIPO . | |

*Primary Examiner*—Paul T. Sewell
*Assistant Examiner*—Tara L. Laster
*Attorney, Agent, or Firm*—Michael V. Drew

[57] ABSTRACT

A composite carrier (10) has a handle structure (20) with a hand-gripping portion (22, 23) in upright relation to an attached article-engaging panel structure (24, 25). In one embodiment of the handle structure (20) the panel structure is a pair of panels (22, 23) formed from flexible sheet material. Each sheet (22, 24) has at least one deformable aperture (31) for engaging the neck of an article (31). In an alternate embodiment of the handle structure (40) the panel structure is a panel (44) attached in generally perpendicular relation to the hand-gripping portion. The generally horizontal panel has at least one neck-receiving aperture (46). Each neck-receiving aperture (46) has at least one foldably attached tab (48) extending inwardly into the aperture for engaging the flanged neck of an article such as the crown of a bottle. The second part of the composite carrier (10) is a tubular, wrap-around type carton (30) having top, side and bottom walls. The top wall (32) has a slot (33) through which the handle portion passes.

13 Claims, 5 Drawing Sheets

COMPOSITE ARTICLE CARRIER

BACKGROUND OF THE INVENTION

The invention relates generally to article carriers, and more particularly to a composite neck-engaging and wrap-around type article carrier.

BACKGROUND

A carrier which engages articles about their respective necks is useful for packaging articles such as bottles. Such carriers may be referred to as "clip-type" carriers because of the manner in which they "clip" the necks or bodies of articles such as bottles or cans. The clip-type neck-engaging carrier is useful because since it only engages the neck or body of an article it can be made from a minimum amount of material which is sufficient to retain and support the articles. The clip-type neck-engaging carrier is often desired over a wrap-around style or basket style carrier because the handle on a clip-type neck-engaging carrier is normally easier to grasp. However, some of the primary attributes of a clip-type carrier are undesirable features for other reasons. For example, the clip-type carrier can be constructed extremely inexpensively from a minimum amount of plastic film. However, when so constructed the carrier does not provide an adequate display surface so often desired by purveyors of products sold in bottles, cans and similar objects packaged in such carriers. Conversely, a wrap-around style carrier provides a significant amount of display space but very often does not possess a handle that is as convenient and easy to use as a handle on a clip-type carrier. What is needed is a carrier which has a handle having attributes of a clip-type carrier in addition to display attributes of a wrap-around-type carrier.

SUMMARY OF THE INVENTION

In a preferred embodiment of the invention one part of a composite carrier has a handle structure with a hand-gripping portion in upright relation to an attached article-engaging panel structure. In one embodiment of the handle structure the panel structure is a pair of panels formed from flexible sheet material. Each sheet has at least one deformable aperture for engaging the neck of an article. In an alternate embodiment of the handle structure the panel structure is a panel attached in perpendicular relation to the hand-gripping portion. The generally horizontal panel has at least one neck-receiving aperture. Each neck-receiving aperture has at least one foldably attached tab extending inwardly into the aperture for engaging the flanged neck of an article such as the crown of a bottle. The second part of the composite carrier is a tubular, wrap-around type carton having top, side and bottom walls. The top wall has a slot through which the handle portion passes.

In the composite carrier of the present invention the handle structure provides a convenient means for grasping the carrier while the tubular carton provides optimum display area and, if desired, support for additional articles. The composite carrier provides the advantages of two types of carriers at a minimum cost increase over either type alone.

Other advantages and objects of the present invention will be apparent from the following description, the accompanying drawings, and the appended claims.

DETAILED DESCRIPTION OF THE PREFERRED EMBODIMENT

Figure 3:
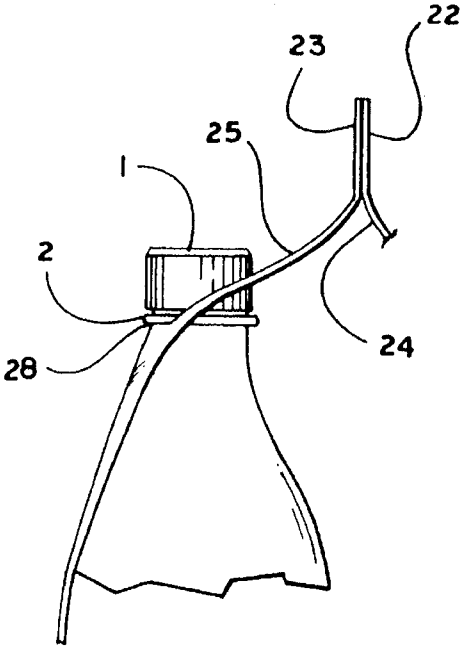
FIG. 3 is a sectional illustration of the handle structure of the composite carrier of FIG. 1 in engagement with a bottle.

The features of the invention will be explained in greater detail through the following description of a preferred embodiment of the invention. In the various views of the figures used and referred to to illustrate the preferred embodiment of the invention the same reference numerals are used to refer to like features.

Figure 1:
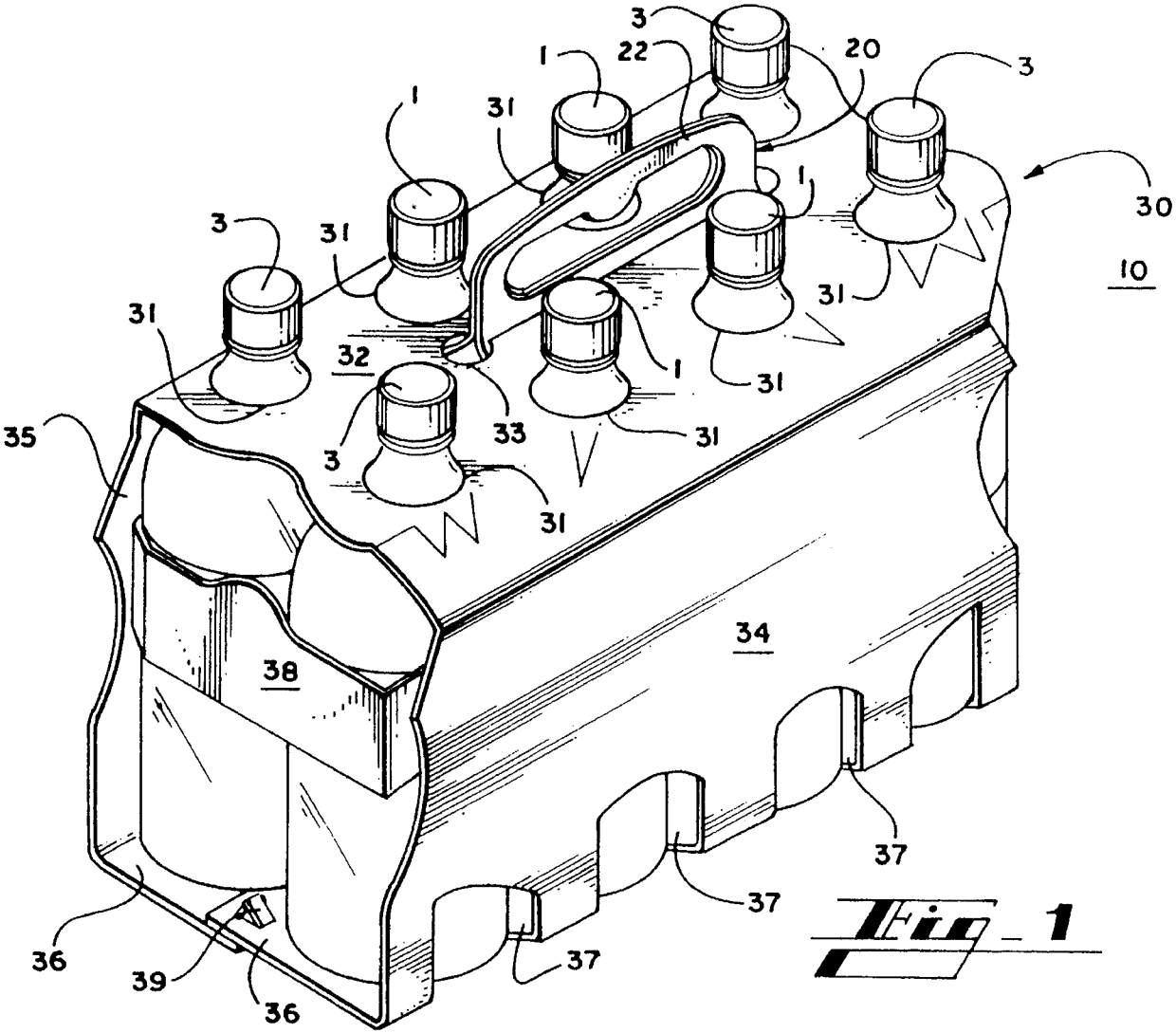
FIG. 1 is an isometric illustration of a composite article carrier according to a preferred embodiment of the present invention.

Referring first to FIG. 1, therein is illustrated a composite carrier 10 according to a preferred embodiment of the invention. The two main components of the carrier 10 are a handle structure 20 and a wrap-around carton 30. The hand-grip portion of the handle structure 20 extends through the top wall 32 of the wrap-around carton 30. Bottles 1, 3, as the packaged articles, project through apertures 31 in the top wall 32 of the carton 30. Side walls 34, 35 extend from the top wall and tube-forming closure of the carton 30 is completed by bottom wall panels 36 joined by a locking mechanism. Although the tube-like carton 30 may be closed by a variety of means, such as adhesives or distinct mechanical fasteners, in the preferred embodiment illustrated mechanical locks 39 struck from the bottom wall panels are utilized. A suitable lock of this nature is shown in U.S. Pat. No. 4,491,223. Though not essential to the operation of the invention the carton 30 also has bottle-retention tabs 37 for helping to secure bottles 1, 3 in place and a UPC (uniform price code) shield 38 at each end for masking the UPC symbol on the individual end most articles (bottles) 3.

Figure 4:
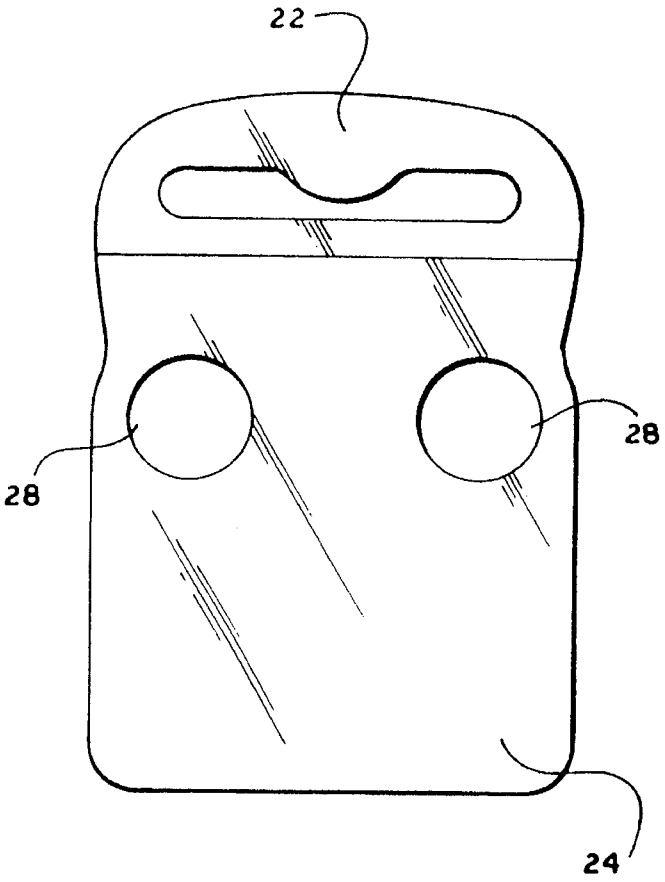
FIG. 4 is a plan view of the handle structure of the composite carrier of FIG. 1.
Figure 2:
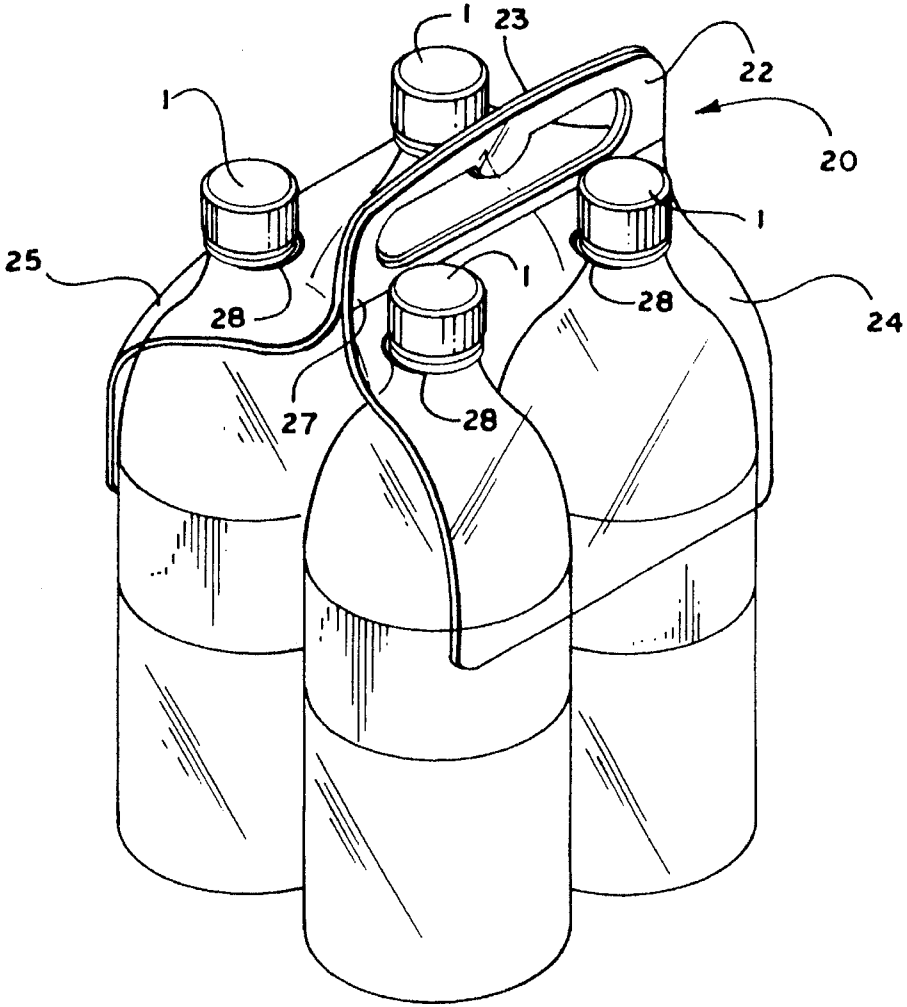
FIG. 2 is an isometric illustration of the handle structure of the composite carrier of FIG. 1 engaging bottles.

Referring now to FIG. 2, the handle structure 30 of the preferred embodiment is shown in greater detail. The handle structure in the embodiment of FIGS. 1 and 2 is preferably made of flexible sheet material such as plastic film. The handle structure 20 has a hand grip portion 22, 23 from which bottle support panels 24, 25 extend. In the preferred embodiment a two-ply handle structure is formed from two sheets of flexible material wherein the hand grip portion 22, 23 is separated from the panels portion 24, 25 along a line 27 which joins the two sheets. Use of the two sheets and the joinder described results in a two-ply hand grip portion 22, 23 and a pair of bottle support panels 24, 25. Although the hand grip portion could be formed from a single sheet of material making the entire handle structure two-ply facilitates ease of manufacture through the use of identical sheets that may be placed in facing relationship to create the structure. The two-ply handle structure may also be formed from a single sheet of flexible material folded over upon itself to create the two-ply hand grip and dual bottle support panels. Each bottle support panel has apertures 28 for engaging the tops of bottles. As an alternative embodiment of the handle structure, particularly in the folded-over embodiment, the two plies may remain unjoined at the space between the hand grip portion and the bottle apertures. Referring now also to FIG. 3, the manner in which the crown of a bottle 1 is engaged when the handle structure 20 is lifted is shown. Referring now momentarily to FIG. 4, the solitary handle structure 20 is shown in plan view. In this plan view there is clearly shown the spatial relationship between the hand grip portion 22 (the portion of the ply 23 below is not visible in this view), the line of adjoinment 27 of the hand grip portion 22 (and 23) and bottle support panel 24 (and 25), and the bottle-engaging apertures 28.

Figure 5:
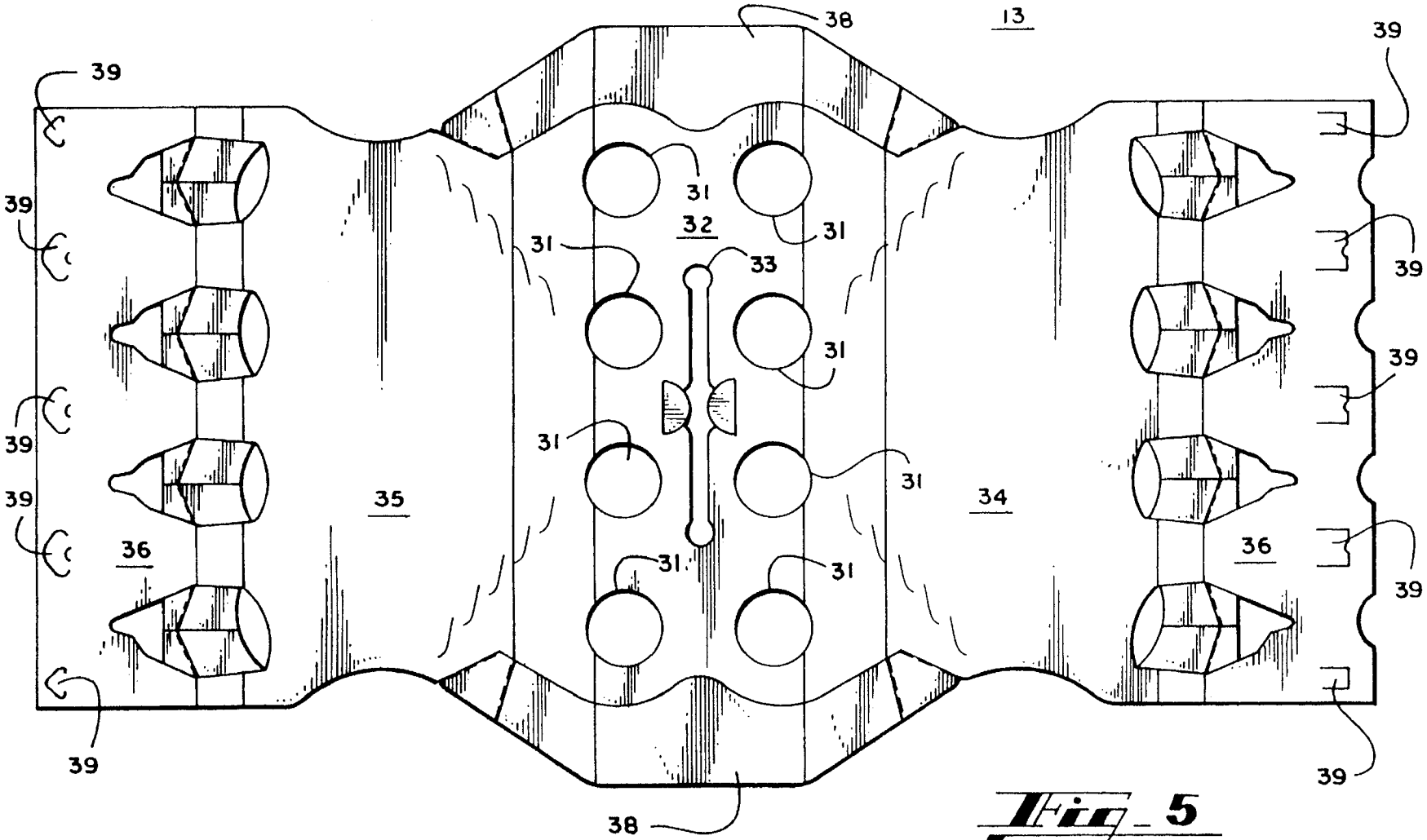
FIG. 5 is a plan view of a blank for forming the wrap-around carton of the composite carrier of FIG. 1.

Referring now to FIG. 5, a blank 13 for forming the wrap-around carton 30 portion of the carrier 10 shown. The plan view of FIG. 5, clearly shows the elements of the carton 30 discussed above, namely, the top wall 32 with its bottle apertures 31 and slot 33 for the handle hand grip portion 22, 23, the side walls 34, 35 joined to either side of the top wall, the bottom wall panels 36 joined to the respective side walls 34, 35, the bottle retention tabs 37 and the locking tabs 39 for joining the bottom wall panels 36.

To utilize the invention the top (or neck) portions of bottles (articles) 1 are inserted into the apertures 28 of the handle structure. The apertures 28 are sized smaller than the tops of bottles 1 which will be received. The apertures 28 are deformable, that is, able to be stretched to snugly engage the bottle tops. In the preferred embodiment, deformation of the apertures is achievable because the panels 24, 25 are made from sheets of flexible material. Referring momentarily to FIG. 2, once bottles 1 are inserted into the handle structure the bottommost portions of the support panels 24, 25 drape the shoulder and/or other body portions of the bottles 1 adjacent the neck of the bottles 1. Referring now again to FIG. 1, to form the composite carrier 10, the hand grip portion 22, 23 of the handle structure 20 is inserted through the slot 33 in the top wall 32 of the carton 30. When the carton 30 is formed into a tube shape the support panels 24, 25 of the handle structure 20 are sandwiched between the bodies of the bottles 1 and the side walls 34, 35. The compressive force placed upon the support panels 24, 25 help hold the panels in place and, together with the snug engagement of the bottles 1 by the deformable apertures 28 of the handle structure 20, maintain the bottles locked within the handle structure 20. Although the handle structure could be arranged to receive as few as a single bottle a greater number may be engaged in accordance with the features of the invention. In the preferred embodiment, as shown, four are engaged. The carton 30 is held in place because it is formed into a tube which envelopes the handle structure 20 and the bottles 1 engaged by it. Once the carton 30 is secured around the handle structure 20 and bottles 1 additional bottles 3 may be engaged and supported by the carton 30 at the ends of the carton 30. As few as one additional bottle 3 may be engaged and supported. The preferred embodiment adds two bottles 3 at each end of the carton 30.

Figure 7:
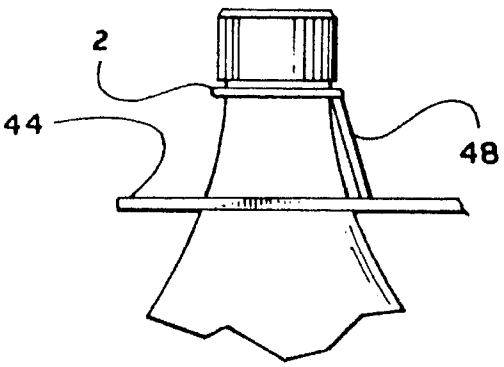
FIG. 7 is a sectional illustration of the handle structure of FIG. 6 in engagement with a bottle.
Figure 6:
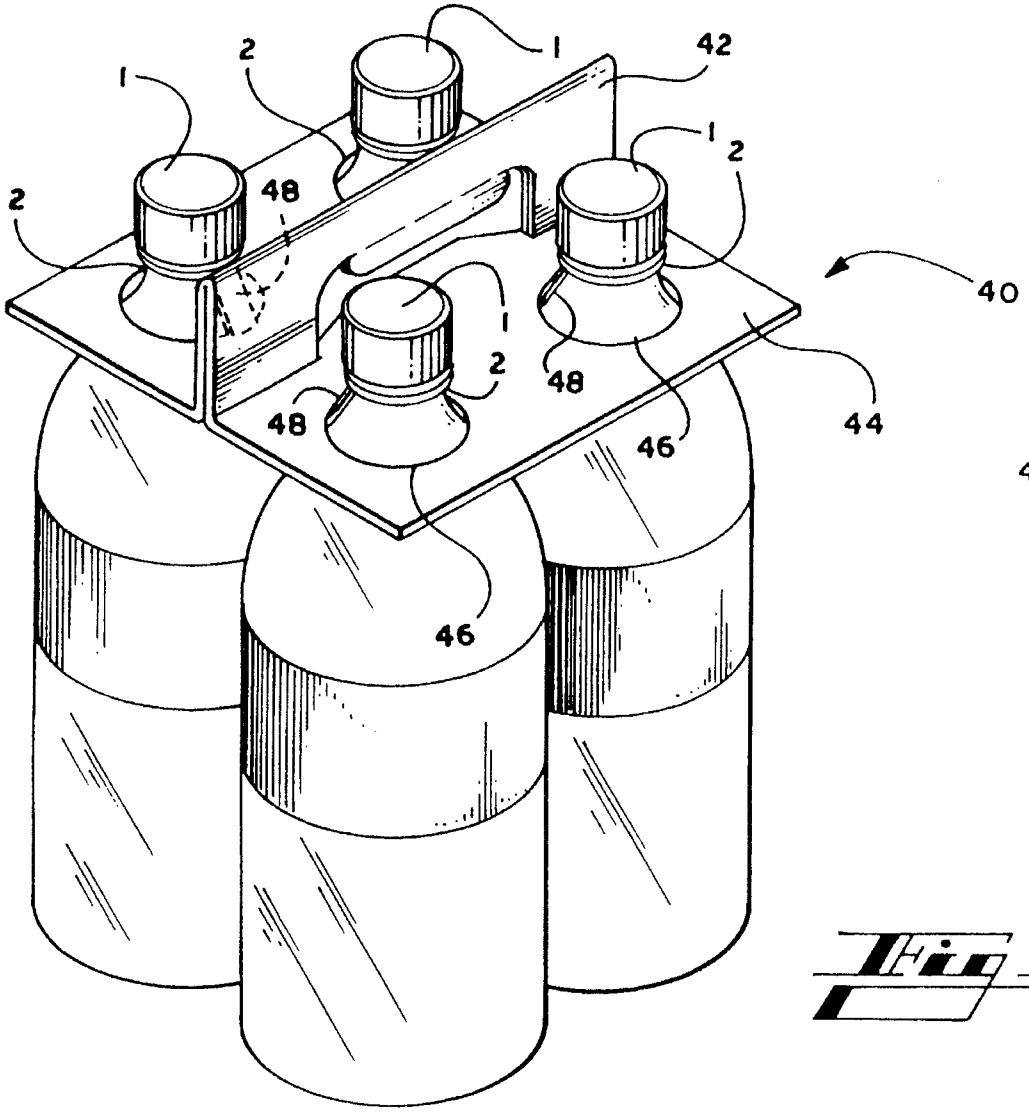
FIG. 6 is an isometric illustration of an alternate embodiment of the handle structure for the composite carrier of FIG. 1.
Figure 8:
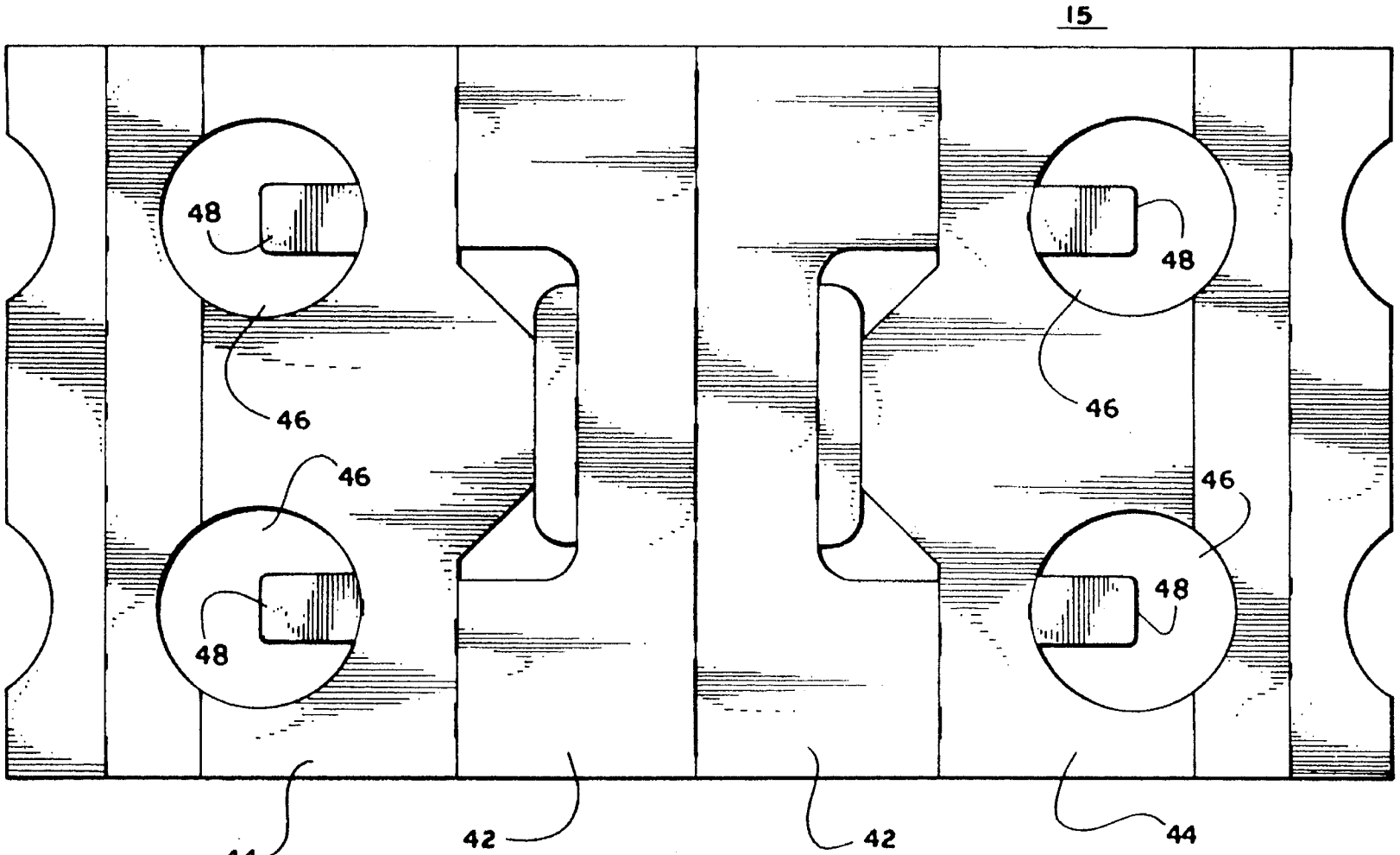
FIG. 8 is a plan view of a blank for forming the handle structure of FIG. 6.

Referring now to FIGS. 6 and 7 an alternate embodiment of a handle structure 40 for the carton 30 is shown. The handle structure 40 of the alternate embodiment makes use of more rigid material than the flexible sheet of the preferred embodiment of FIGS. 1–4, such as paperboard, semi-rigid plastic or rigid plastic. In the alternate-embodiment handle structure 40 the hand grip portion 42 is in a generally orthogonal position with respect to a generally horizontally-oriented support panel 44. The support panel 44 may be foldably attached to the hand grip portion 42, particularly when the handle structure is made of paperboard. Apertures 46 are formed in the support panel 44 for receiving the necks of bottles 1. Bottles 1 are retained in the apertures 46 of the support panel by means of article-engaging tabs 48. Although several article-engaging tabs 48 may be used, as few as one may be used, as illustrated in the preferred embodiment. Each article-engaging tab 48 projects into its associated aperture 46 and is pivotally connected to the article support panel 44. The article-engaging 48 tab engages the underside of a flanged portion of the neck or body an article. In the preferred embodiment the flanged portion which is to be engaged by the tab 46 is the crown 2 of the bottle 1. Referring now to FIG. 8 a blank 15 suitable for forming the handle structure shown in FIGS. 6 and 7 is shown. The blank 15 is essentially a mirror image of itself about the line separating the hand grip portions 42. The handle structure 40 is erected by folding the hand grip portions 42 into face contacting relationship about a perforated score line separating the two portions 42. The support panel segments 44 are folded into essentially perpendicular relationship with the hand grip portions 42 about perforated score lines separating the support panels 44 from the hand grip portions 42.

The alternate handle structure 40 is utilized to form the composite carrier 10 in the same manner as the handle structure 20 discussed above. The hand grip portion 42 of the erected handle structure 40 (with engaged bottles 1) is inserted through the slot 33 in the top 32 of the carton 30. The carton 30 is then closed to form a tube as previously described.

In the composite carrier 10 each handle structure 20, 40 secures the articles (bottles) 1 engaged providing a convenient effective means for transporting the bottles 1, 3) while the carton 30 provides an effective display surface and a means for securing and transporting additional bottles. Other modifications may be made in the foregoing without departing from the scope and spirit of the claimed invention.

What is claimed is:

1. An article carrier for articles having necks comprising:

a handle structure having a pair of flexible panels depending from a handle grip portion having a hand hole aperture, each said flexible panel having at least one deformable aperture for closely receiving the neck of the article proximate said handle portion; and a tubular carton including a top wall, opposing side walls adjoining said top wall, and a bottom wall adjoining said opposing side walls, said top wall having a slot for receiving said handle portion and second apertures for receiving respective necks of the articles.

2. The article carrier of claim 1, wherein said handle portion and said panels are formed from a pair of sheets of flexible material in flat face relationship joined mediate said handle portion and said deformable apertures.

3. The article carrier of claim 1, wherein said handle portion and said panels are formed from a sheet of flexible material folded over upon itself.

4. An article carrier for articles having flanged necks comprising:

a handle structure formed from flexible material having an upright rigid handle portion with a hand hole aperture and having an article engagement panel extending substantially perpendicularly from a lower portion of said upright handle portion, said article engagement panel having a plurality of apertures for receiving necks of the articles, each said aperture having at least one tab extending inwardly thereof for engaging an underside of the flange of the neck of the articles; and a tubular carton including a top wall, opposing side walls adjoining said top wall, and a bottom wall adjoining said opposing side walls, said top wall having a slot for receiving said upright handle portion and second apertures for receiving the necks of the articles.

5. The article carrier of claim 4, wherein said tab is foldably joined to said article engagement panel.

6. The article carrier of claim 4, wherein said handle structure comprises paperboard.

7. A package comprising:

articles having necks;

a handle structure having a pair of flexible panels depending from a handle grip portion having a hand hole aperture, each said flexible panel having deformable apertures closely receiving the respective necks of said articles proximate said handle portion; and a tubular carton enveloping said articles and said handle structure including a top wall, opposing side walls adjoining said top wall, and a bottom wall adjoining said opposing side walls, said top wall having a slot receiving said handle portion and second apertures receiving respective said necks of said articles.

8. The package of claim 7, wherein said handle portion and said panels are formed from a pair of sheets of flexible material in flat face relationship joined mediate said handle portion and said deformable apertures.

9. The package of claim 7, wherein said handle portion and said panels are formed from a sheet of flexible material folded over upon itself.

10. The article carrier of claim 7, wherein the articles have flanged necks and said at least one deformable aperture respectively engages the flanged necks of the articles.

11. A package comprising:

articles having necks;

a handle structure formed from flexible material having an upright rigid handle portion with a hand hole aperture and having an article engagement panel extending substantially perpendicularly from a lower portion of said upright handle portion, said article engagement panel having apertures receiving respective said necks of said articles, each said aperture having at least one tab extending inwardly thereof engaging an underside of the flange of each respective said neck of said articles; and a tubular carton enveloping said articles and said handle structure including a top wall, opposing side walls adjoining said top wall, and a bottom wall adjoining said opposing side walls, said top wall having a slot for receiving said upright handle portion and second apertures receiving respective said necks of said articles.

12. The package of claim 11, wherein said tab is foldably joined to said article engagement panel.

13. The package of claim 11, wherein said handle structure comprises paperboard.

* * * * *